US006290617B1

(12) United States Patent
Cole et al.

(10) Patent No.: US 6,290,617 B1
(45) Date of Patent: Sep. 18, 2001

(54) GOLF DIVOT REPLACEMENT TOOL

(76) Inventors: Todd E. Cole, 426 Yanke Rd.; Patrick J. Kowalski, 415 East Hwy. 20, both of Michigan City, IN (US) 46360

( * ) Notice: Subject to any disclaimer, the term of this patent is extended or adjusted under 35 U.S.C. 154(b) by 44 days.

(21) Appl. No.: 08/992,637

(22) Filed: Dec. 18, 1997

(51) Int. Cl.[7] ..... A63B 57/00
(52) U.S. Cl. ..... 473/408; 473/286
(58) Field of Search ..... 473/406, 408, 473/285, 286, 282; D21/234

(56) References Cited

U.S. PATENT DOCUMENTS

| | | | | |
|---|---|---|---|---|
| 3,185,483 | | 5/1965 | Klynman . | |
| 3,622,157 | * | 11/1971 | Hatch | 473/408 |
| 4,216,831 | | 8/1980 | Ritchie . | |
| 4,239,216 | | 12/1980 | Bauer . | |
| 4,627,621 | * | 12/1986 | Tate | 473/286 |
| 4,799,684 | | 1/1989 | Rango . | |
| 4,925,190 | | 5/1990 | Learned . | |
| 4,955,609 | | 9/1990 | Kassen . | |
| 4,974,842 | * | 12/1990 | Widman | 473/408 |
| 5,152,524 | * | 10/1992 | Brown | 473/286 |
| 5,226,647 | * | 7/1993 | Notarmuzi | 473/408 |
| 5,437,449 | * | 8/1995 | Zink | 473/286 |
| 5,511,785 | | 4/1996 | Rusin, Jr. . | |
| 5,529,299 | | 6/1996 | Bellagamba . | |

* cited by examiner

*Primary Examiner*—Steven Wong
(74) *Attorney, Agent, or Firm*—Donald C. Casey, Esq.

(57) ABSTRACT

A golf club accessory device is described. The device of this invention is an essentially flat plastic member having a forked end for use in replacing divots or green repair, and integral jaw members for attachment of the device to the club shaft adjacent the head. The end of the device opposite the forked portion provides a cradle, and a removable ball marker is carried by the device. The ball marker typically has a spindle that is pressed fitted through a hole in the device so that it can be physically separated to be used by the golfer.

5 Claims, 3 Drawing Sheets

GOLF DIVOT REPLACEMENT TOOL

BACKGROUND OF THE INVENTION

1. Field of the Invention

This invention relates to the game of golf and to an accessory device to assist in playing the game. The device of this invention combines functions of divot replacement, a ball marker, and provides a support for a club when not in use or a general supporting accessory, in a single device.

2. Description of the Prior Art

In the game of golf, the condition of the green is of utmost importance to both the occasional and serious golfer. The greens need to be free from irregularities that can occur when the ball strikes the green, a putter strikes a green, or marks are made by the cleats used on the soles of golf shoes. These irregularities are known as divots, and are often repaired with a pronged device carried in the golfer's pocket or golf bag.

The obvious drawbacks to carrying these devices in either a pocket or golf bag is that the device can either tear clothing, when carried in a pocket, or become inconvenient to locate when carried in the depths of a golf bag.

In addition, golfers find it necessary to carry a ball marker, with which to mark the position of the ball on the green, in order to remove that ball from the path of other golfers attempting to putt on the same green. Golfer's often use a dime or penny for this purpose. This can become inconvenient if the golfer neglects to have change in his or her pocket, and the alternative of leaving one's ball in the path of another person's putt is unacceptable golf etiquette.

A wide variety of accessory devices are known in the prior art. A number of such devices such as those shown in U.S. Pat. Nos. 4,239,216; 5,511,785; 4,925,190, and 4,799,684 are stored within the handle of the golf club. In these devices, the handle is hollow and a cap is threadably received in the open end of the handle. The device is incorporated in the handle so that in order to use the device the cap must be removed and the device removed.

In U.S. Pat. No. 3,771,794 a device is similarly threadably received on the end of the handle, but it is not retained within the handle proper when not in use.

The above described devices then all require a special purpose golf club and a standard golf club cannot be used without structural changes.

Similarly in U.S. Pat. No. 4,955,609 a divot replacement device is mounted on the grip of a golf club and a spring detent is used to extend or retract the divot replacement device itself. Therefore, this device must be either manufactured with the golf club, or the conventional golf club must be structurally adapted to mount the device. In either event, it is likely to be in the way when the club is used for golfing.

While the prior art may function as desired, the fact that they all require special purpose golf clubs, or structural modifications of existing golf clubs minimizes their acceptability to the average golfer.

It is also known in the prior art to have separate divot replacement devices which are multi-functional and which are not attached to the golf club. In U.S. Pat. Nos. 5,529,299; 5,226,647 and 4,627,621 representative devices are described. In each of these devices it is intended that the implement either be stored in the golfer's pocket, or in the golf bag. In either event, it is inconvenient to use.

In U.S. Pat. No. 3,185,483, a divot replacement device is incorporated in the head of the putter. While this device is convenient to access, it also requires a special purpose golf club and requires that the golfer accept a hollow putter head in contrast to the standard putter. In other words, the specially adapted golf club needed to store the device may have weight and impact characteristics different from a standard club.

Finally, U.S. Pat. Nos. 4,216,831 and 5,437,449 describe devices which are attached to the golf club itself for green repair but these devices are attached to the grip on the club shaft. In these devices, then, unless the accessory is unclipped from the grip, the accessory will be inserted in the golf bag after use when the club is returned to the bag. In this way, the accessory may become unclipped from the grip within the bag requiring the golfer to explore the depths of the bag to retrieve it. While the devices described are clipped rather than permanently attached to golf clubs and therefore are usable with a standard golf club without additional adaptation, the clips described are attachable only to the grip end of the club rather than the shaft itself.

SUMMARY OF THE INVENTION

Accordingly, there is a need for a golf accessory device which is used to repair divots, to clean cleats, to provide a removable ball marker, and similar functions, which can be stored, clipped to the shaft of the golf club as compared to the grip so that it is readily accessible when the club is stored in the golf bag. It can then be removed from the club for use without removing the club from the bag, or the club can be used with the device clipped thereto. The device of this invention may be constructed from standard plastic material and incorporates a forked end which can be used to repair greens, replace divots, clean cleats, or it may be inserted in the ground to act as a support for other objects. The opposite end is provided with a cradle, and intermediate thereto a removable ball marker is provided which is preferably press fitted into the body of the device, but may be threadably received. The device of this invention then is intended to be removably clipped to the shaft of the golf club adjacent the head so that when the club is stored in a golf bag it can be readably removed.

Accordingly it is an object of this invention to provide a golf divot replacement accessory which provides multiple functions, and which may be easily stored in a golf bag for retrieval.

It is yet another object of this invention to provide a golf club accessory which is typically clipped to the shaft of a golf club adjacent the head but which can be removed manually for use, and then replaced.

It is still another object of this invention to provide a golf accessory which is typically stored clipped to the shaft of a golf club and which provides a forked end for use in divot replacement and green repair, cleat cleaning, and a cradle at an opposite end.

It is yet another object of this invention to provide a golf accessory which combines the functions of a divot replacement tool, a removable ball marker and a support cradle in a device which can be removably clipped to the shaft of a golf club adjacent its head.

These and other objects will become readily apparent with reference to the drawings and following description.

DETAILED DESCRIPTION OF THIS INVENTION

Figure 3:
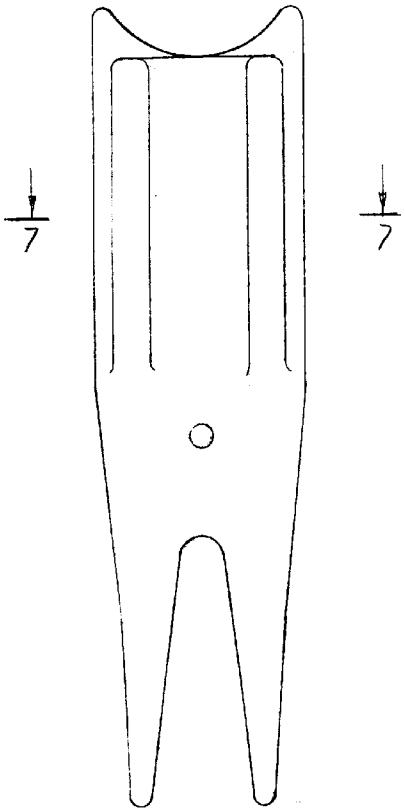
FIG. 3 is a rear view of the device of FIG. 1.
Figure 2:
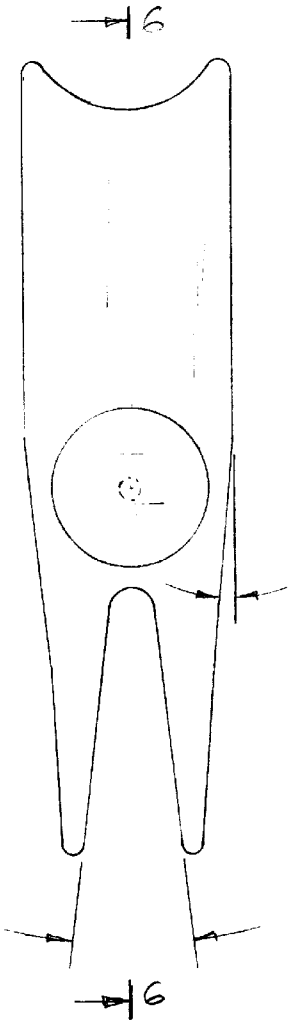
FIG. 2 is a front view of the device of FIG. 1.

With attention to the drawings and to FIGS. 1–7 in particular, the device of this invention 10 generally includes a flat plastic plate 12 having a removable plastic ball marker 14 mounted in the central portion thereof. The lower end defines a fork 16 having opposed legs 18 and 20 which terminate in rounded end portions 19 and 21 and an upper portion 22 which defines a cradle 24 therein. One face 26 mounts a clip 28 and the ball market 14 is generally disposed on the opposite face 30.

Figure 1:
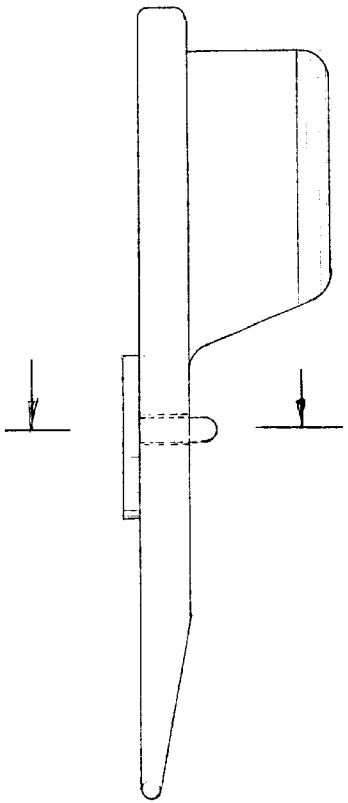
FIG. 1 is a side view of the device of this invention.
Figure 7:
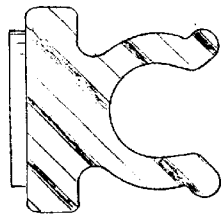
FIG. 7 is a cross-sectional view taken along lines 7—7 of FIG. 3.
Figure 6:
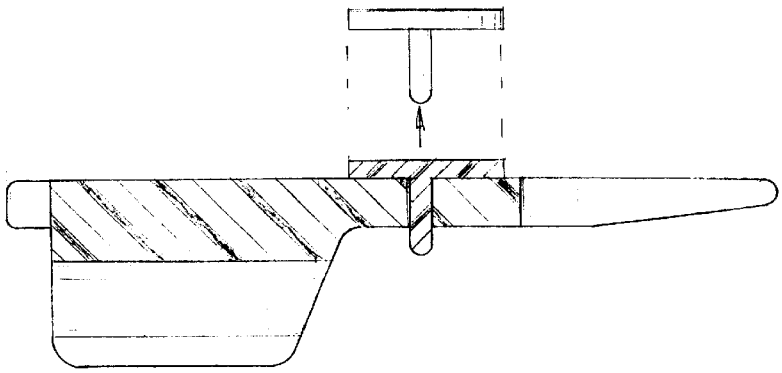
FIG. 6 is a cross-sectional view taken along lines 6—6 of FIG. 2.

As shown in FIGS. 1 and 6, the ball marker 14 in a preferred embodiment has a central spindle 34 which is received in a hole 36 in the central portion 26 of the plate 12. In the embodiment shown, the hole 36 is intended to slidably receive the pin 34 which has a slight taper so that the ball marker 14 is press fitted in the central portion 26 of the device 10. As will be obvious to those skilled in the art, the ball marker spindle 34 could be threadably received in the hole 36. It is important that the ball marker 14 be retained on the device 10 through normal usage thereof, as will be subsequently explained, but is readably removable, manually, by the user.

Figure 8:
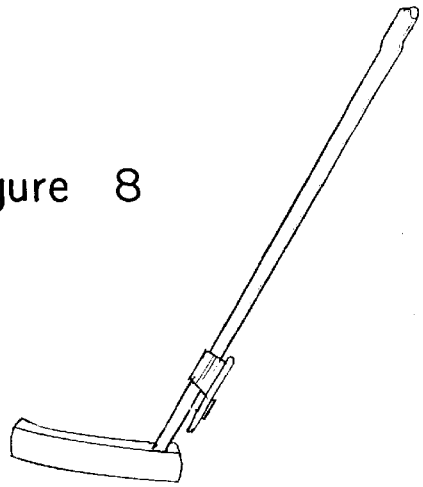
FIG. 8 is a fragmentary perspective side view showing the device of this invention mounted on a golf club.

The upper portion 12 of the device 10 mounts jaws 28 which are intended to receive the shaft 40 of a club 42. As shown in FIG. 8 it is intended that the jaws 28 be press fitted on the shaft 40 adjacent the club head 44. As is obvious to those skilled in the art, when the club 42 is inserted into a golf bag, it is inserted grip end 46 first, leaving the club head 44 extending upwardly, out of the bag. If the device 10 is attached at the grip end 46 it will be within the golf bag, and inaccessible.

Figure 4:
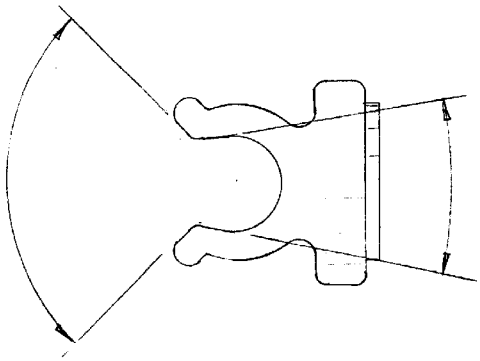
FIG. 4 is a top view of the device of FIG. 1.
Figure 5:
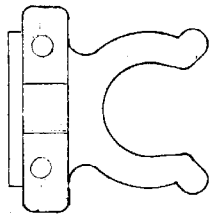
FIG. 5 is a bottom view of the device of FIG. 1.

In addition, as the club is inserted in the bag there is the possibility that the device 10 can be separated from the club 42 in the interior of the bag. The jaws 28 therefore are dimensioned to receive only the shaft 40 of the club 42 and not the grip 46. Although the angle 48 shown in FIG. 4 is preferably 90 degrees and the angle 50 is preferably 14.6 degrees, the diameter of the open area in the jaws 28 is only about ⅓ inch. In this way the user will not be likely to attempt to attach the device 10 to the grip 46 because, as will be obvious to those skilled in the art, the grip is substantially thicker. The jaws 28 also are not tapered longitudinally and the open area is a at constant diameter as shown for example in FIG. 1. The grip of a club, in contrast has a substantial taper.

Figure 9:
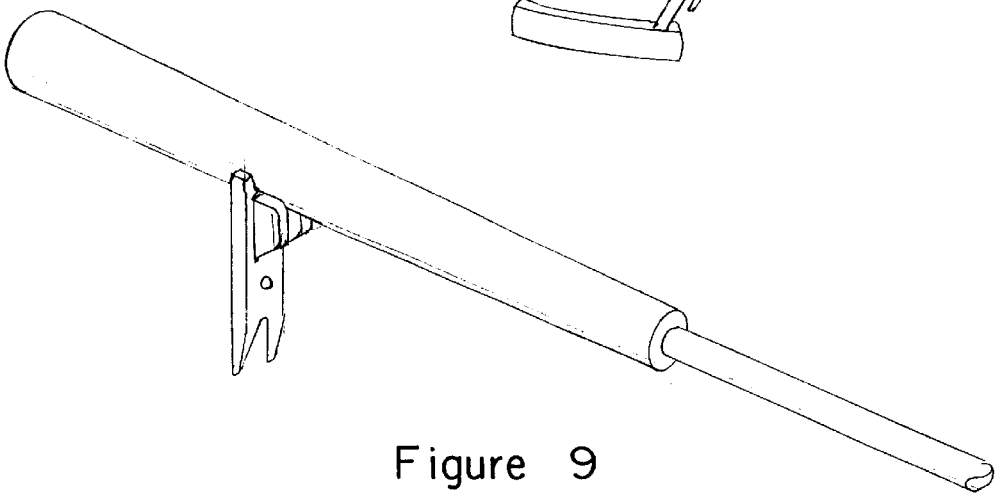
FIG. 9 is a fragmentary perspective view showing the device of this invention supporting a golf club handle.

In order to facilitate green repair or cleat cleaning with the device of this invention the forked lower portion 16 has legs 18 and 20 which are disposed at an angle 54 of about 11 and ⅔ degrees. In addition, as shown at FIG. 1, the legs 18 and 20 are slightly tapered relative to the longitudinal vertical axis of plate 12 at an angle of about 6 degrees. In this way the forked end 16 could be used in the conventional fashion to replace divots and the like. In addition, the device could be inserted in the ground as shown in FIG. 9 to support, at cradle 24, the club grip 46 if it is desired to insert the forked end 16 into the ground. In this way the club can be placed on the ground without getting the grip 46 wet or dirty. The cradle 24 typically has a radius of curvature of about ⅜ inch.

Figure 10:
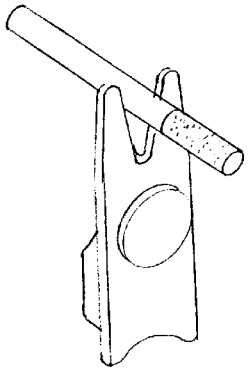
FIG. 10 is a perspective view showing the device of this invention supporting a cigarette.
Figure 11:
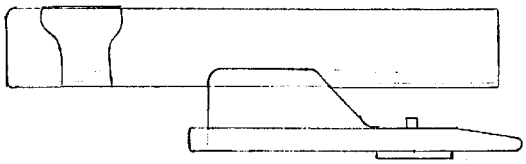
FIG. 11 is a side view showing the device of this invention supporting a cigar.

The device of this invention also, as shown in FIGS. 10 and 11, could be used to support the cigarette 60 in the fork 16 and can be used to support a cigar 62 in the jaws 28 while the user is making a golf shot.

In summary, the device of this invention is a multiple purpose accessory for use in golfing which is mounted on the club shaft by a resilient clip portion so that when the club is stored in a golf bag, with the club head exposed in the normal fashion, the device of this invention will be mounted on the shaft adjacent the head readily accessible to the user. The device can be separated from the club head for use in replacing divots or the like, or for supporting the club head or other objects, such as smoking devices for example. A removable ball marker is also provided so that the ball marker can be readily placed on the ground and the golfer will not have to depend upon having a coin or the like on his or her person. The device of this invention is intended to be constructed of plastic material and the jaw's for attachment to the club shaft are integrally molded therewith. The jaw member is intended to be press fitted onto the club shaft so that the club can be used with the device of this invention attached or can be separated as desired.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

What we claim is:

1. An accessory for a golf club normally removably mounted on a golf club shaft for use in green repair, cleat cleaning, ball marking and as a general support comprising:

a substantially rectangularly elongated plate having a front face and a back face, a top and a bottom, the bottom being bifurcated, forming right and left legs and the top defining a cradle; said plate having opposed jaws integrally extending along a portion of the front face, along the longitudinal axis of said plate, said jaws being mutually spaced equidistantly along their length and dimensioned to be press fitted on a golf club shaft and not the grip; said plate, bifurcated bottom and cradle being contained in a common plane; and removable ball marker mounted on said plate adjacent said jaws, said jaws comprising opposed clip members separated by a constant distance along the longitudinal axis of said plate.

2. The accessory of claim 1 wherein said ball marker includes a disk.

3. The accessory of claim 2 wherein said ball marker includes a spindle extending perpendicularly thereto and said plate defining a hole therethrough dimensioned to slidably receive said spindle therethrough.

4. The accessory of claim 3 wherein said marker comprises a circular disk having a front face and an axis of rotation perpendicular thereto, said spindle extending along said axis.

5. The accessory of claim 1 wherein the distance is about ⅓ inch.

* * * * *